US005740790A

United States Patent [19]

Lipsky

[11] Patent Number: 5,740,790

[45] Date of Patent: Apr. 21, 1998

[54] COUNTER-FLOW HEATING AND AIR CONDITIONING METHOD FOR INSTALLING AIR CONDITIONER UNIT THEREIN

[75] Inventor: Steve S. Lipsky, Bethlehem, N.H.

[73] Assignee: Global Engineering, Inc., Willimantic, Conn.

[21] Appl. No.: 540,263

[22] Filed: Oct. 6, 1995

(Under 37 CFR 1.47)

[51] Int. Cl.[6] ..... F24F 3/00

[52] U.S. Cl. ..... 126/113; 126/110 A; 126/116 A; 62/259.1

[58] Field of Search ..... 126/113, 350 B, 126/110 A, 110 AA, 116 A; 62/259.1

[56] References Cited

U.S. PATENT DOCUMENTS

| | | | |
|---|---|---|---|
| 2,128,245 | 8/1938 | Hager | 126/113 X |
| 2,708,435 | 5/1955 | Lewis | 219/362 |
| 2,740,396 | 4/1956 | Powers | 126/113 |
| 3,453,414 | 7/1969 | Levy | 219/362 |
| 3,840,001 | 10/1974 | Ernest | 126/113 |
| 3,902,473 | 9/1975 | Yeagle | 126/113 |
| 3,908,751 | 9/1975 | Sheppard, Jr. | 165/27 |
| 4,236,505 | 12/1980 | Tarullo | 126/113 X |
| 4,434,782 | 3/1984 | Traeger | 126/116 C X |

OTHER PUBLICATIONS

Miller Installation and Operation Counter Flow Gas Heating Appliance Models MF 55–AG & MG 65–AG, no date.

*Primary Examiner*—Larry Jones
*Attorney, Agent, or Firm*—McCormick, Paulding & Huber

[57] ABSTRACT

A mobile or modular home hot air heating and humidifying system including a counter-flow furnace having a base pan and a housing resting on the base pan and containing a heat exchanger and a blower located above the heat exchanger for directing air downwardly within the housing in heat exchange relation to the heat exchanger and to and through an air outlet opening in the base pan. A humidifier unit resting on the floor below the furnace and structurally supporting the furnace defines a passageway communicating with the air outlet and with a feeder duct which extends downwardly through the floor and connects to a heat distribution duct system below the floor. The humidifier operates in response to operation of the blower. A method for installing a humidifier unit in an existing heating system of the aforedescribed general type is also disclosed.

19 Claims, 2 Drawing Sheets

COUNTER-FLOW HEATING AND AIR CONDITIONING METHOD FOR INSTALLING AIR CONDITIONER UNIT THEREIN

BACKGROUND OF THE INVENTION

This invention relates in general to conditioned air or humidified heating systems and deals more particularly with an improved system of the type which includes a counter-flow hot air furnace supported on or near the surface of a floor for directing heated air downwardly through a feeder duct in the floor and to and through a duct system below the floor which distributes heated air to one or more baseboard or floor outlet registers. The counter-flow furnace generally comprises a compact self-supporting unit which rests on a base pan supported on the floor surface and connected to a feeder duct.

A typical humidified heating system of the aforedescribed general type is illustrated and described in U.S. Pat. No. 3,902,473 to Yeagle on Mobile or Modular Home Humidifier, issued Sep. 2, 1975. Yeagle discloses a heating appliance which includes a housing containing a firebox defining a substantially sealed and vented combustion chamber and a blower located above the firebox for forcing air downwardly past and in heat exchanging relation to the heated firebox and into distribution ducting beneath the floor of the home. The humidifier or air conditioning unit is mounted on the top wall of the housing and adds moisture to air drawn into and through the blower before the air is heated by passing over the firebox. This arrangement is inherently inefficient, generally detrimental to the blower and other parts of the appliance, and reduces the useful life of the appliance.

It is the general aim of the present invention to provide an improved conditioned air or humidified heating system for a building heated by a counter-flow hot air heating appliance wherein air is conditioned by controlling the quantity of moisture the air passing through the system after the air has been heated by the appliance. It is a further aim of the invention to provide an improved air conditioning unit for installation in an existing counter-flow hot air heating system and a method for installing an air conditioning unit or humidifier in a system of the aforedescribed type.

SUMMARY OF THE INVENTION

In accordance with the present invention, an improved air conditioning unit, such as a humidifier unit, is provided for a heating system having a below-the-floor heat distribution duct, a feeder duct communicating with the heat distribution duct and extending upwardly through the floor, a counter-flow heating appliance disposed above the floor and including a housing having an air inlet in the upper portion thereof and a bottom wall having an air outlet therethrough communicating with the feeder duct. The heating appliance includes a source of heat contained within the housing and means for directing air along a flow path from the air inlet downwardly past the source of heat into and through the air outlet and into and through the feeder duct to the heat distribution duct. The air conditioner or humidifier unit is disposed between the housing bottom wall and the floor and has a passageway therethrough communicating with the air outlet and the feeder duct and defining a portion of the air flow path.

DETAILED DESCRIPTION OF PREFERRED EMBODIMENT AND METHOD

Figure 1:
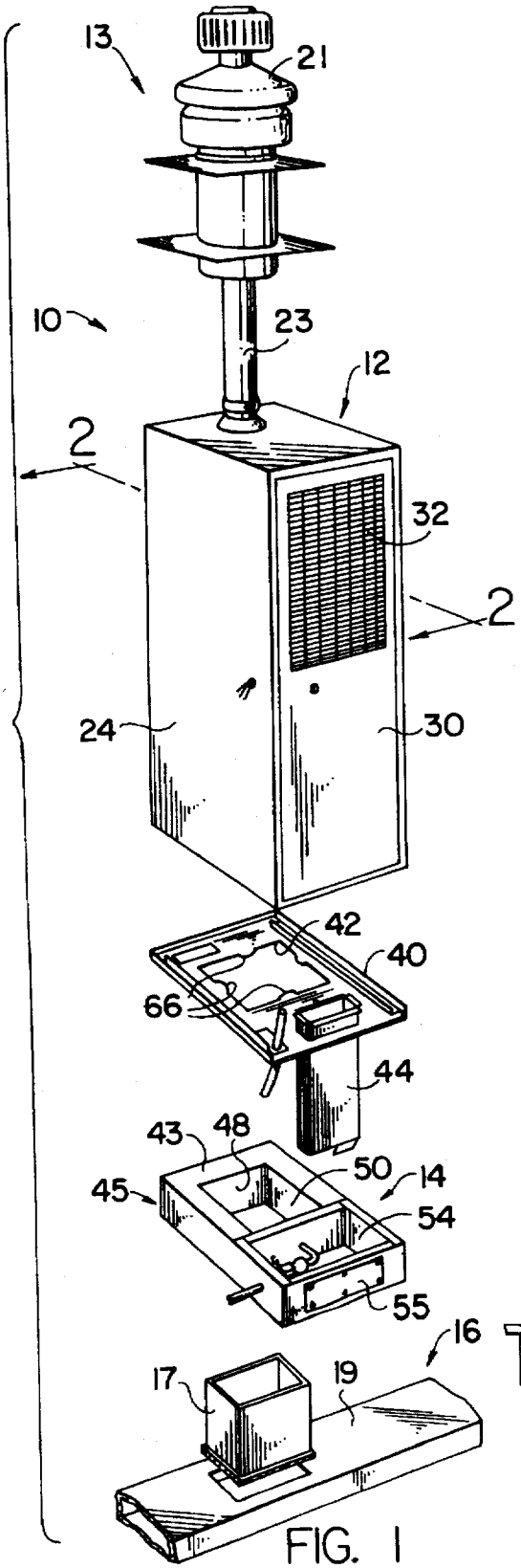
FIG. 1 is an exploded front perspective view of a humidified heating system and embodying the invention.
Figure 2:
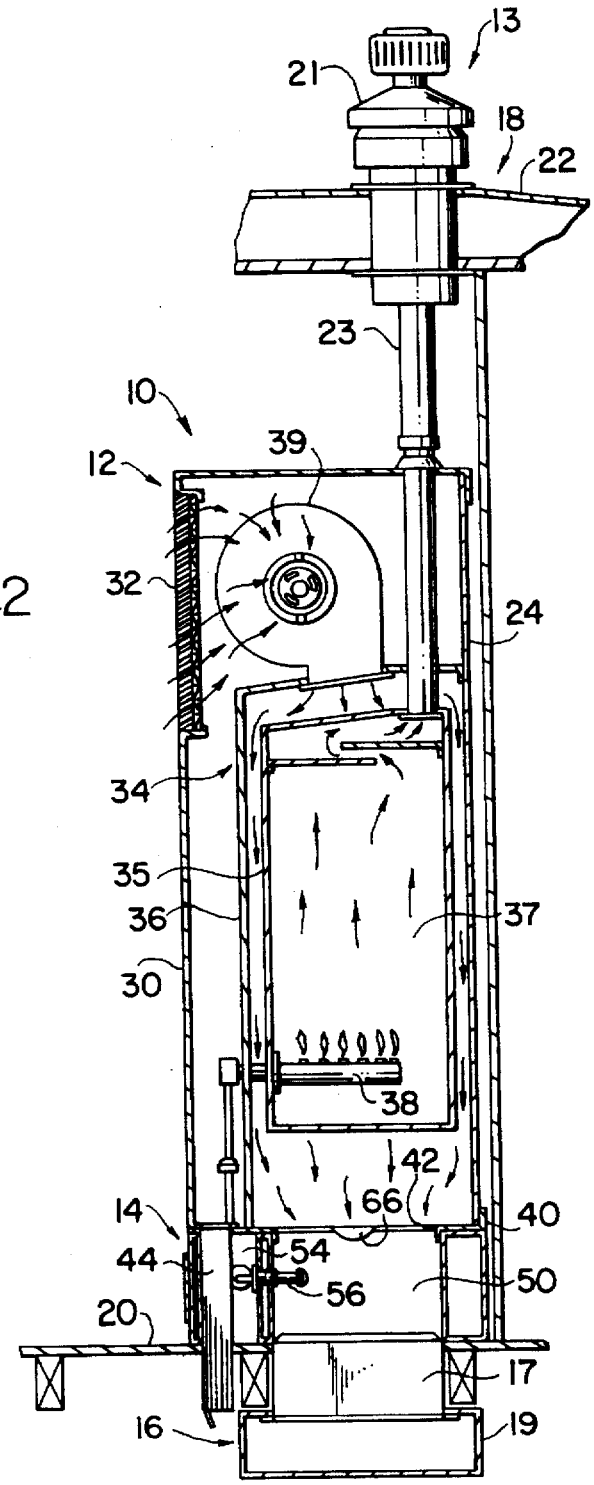
FIG. 2 is a fragmentary sectional view taken generally along the lines 2—2 of FIG. 1 and shows the system installed in a mobile or modular home.

Turning now to the drawings and referring first to FIGS. 1 and 2, a home heating and humidifying system embodying the present invention is indicated generally by the reference numeral 10. The essential components of the system 10 include a counter-flow heating appliance or furnace assembly indicated generally at 12, an air conditioner or a humidifier unit designated generally by the numeral 14, an air distribution ducting system indicated generally at 16 which includes a feeder duct 17 and a hot air distribution duct 19, and a roof jack assembly 13 which includes a stack 23, all of which will be hereinafter more fully described. In FIG. 2 the system is shown installed in a mobile or modular home, designated generally by the numeral 18, which includes a floor 20 and a roof structure 22.

Considering now the heating and air conditioner system 10 in further detail and referring particularly to FIG. 2, the illustrated heating unit 12 comprises a MILLER counter-flow gas heating appliance or furnace produced by Lear-Siegler, Inc. Home Division, Holland Mich. 49423, but it should be understood that furnaces of other manufacture are also suitable for use in the system hereinafter further described. The illustrated furnace is a compact unit suitable for use where available space is limited and may, for example, be installed in a relatively small closet or like space.

The furnace assembly 12 has a generally rectangular housing 24 which includes a removable access door or panel 30. The latter panel forms one side of the housing 24 and has an air inlet or grill 32 near its upper end. The furnace assembly 12 further includes a base pan 40 on which the housing 24 normally rests. The base pan 40 has an air outlet 42 through it which communicates with the interior of the housing 24. A combustion duct 44 depends from and opens upwardly through the base pan 40 and also opens into the housing 24, as shown in FIG. 2.

A heat source or heat exchanger assembly indicated generally at 34 and contained within the housing includes a firebox 35. The firebox is substantially surrounded by a heat shield 36 and defines a combustion chamber 37 which contains a gas burner 38. Although a gas fired appliance is shown, it should be understood that the invention may be practiced with heating appliances of other types wherein the heat source may, for example, comprise an oil burner or an electrical heating element.

A motor driven blower 39, mounted within the upper portion of the housing 24 on the heat shield 36 and proximity the air inlet grill 32, receives air which enters the housing through the air inlet 32 and directs air downwardly along a flow path into the heat exchange 34 and past and in heat exchanging relation to the firebox 35, substantially as shown in FIG. 2.

Further, and in accordance with the invention, structural support for the furnace 12 is provided by the air conditioning humidifier unit 14 which rests on the floor 20 beneath the furnace assembly 12, substantially as shown in FIG. 2.

The illustrated humidifier unit 14 has a generally rectangular body, indicated generally at 45 and preferably fabricated from sheet metal, and includes top and bottom walls indicated at 43 and 46, respectively. An inner sidewall 48 extends between the top and bottom walls and defines a vertically disposed passageway 50 which has a generally rectangular cross section which substantially complements the cross section of the feeder duct, the upper marginal portion of which is received within the passageway 50. The upper end of the passageway 50 communicates with and substantially complements the base pan opening 42. The outer sidewalls of the humidifier unit 14 are spaced laterally outwardly from the inner sidewall 48. The spaces defined by the inner and outer sidewalls and the top and bottom walls of the humidifier body generally provide air insulating barriers for the passageway 50. The inner and outer sidewalls of the humidifier body further cooperate with the floor 20 and a portion of the base pan 40 to define a rectangular compartment 54. A removable panel 55 secured to the front wall of the body 45 by threaded fasteners cover an access opening in the front wall of the body which allows access to the compartment 54.

Moisture is introduced into the humidifier or more specifically into the passageway 50 through a nozzle 56 mounted in fixed position relative to the humidifier body 45 and disposed within the passageway 50. The nozzle is accessible for servicing or replacement through the compartment 54 when the access panel 55 is removed. A Delavan $0.60\times90^{oH}$ nozzle is presently preferred for this purpose. The nozzle is connected in series with a control valve 58 and receives water from an associated supply source. The illustrated water supply source comprises a water supply tube 60 which forms a part of the plumbing system in the home 18. The nozzle is connected to the supply tube 60 by a length of flexible tubing 62 and a threaded saddle valve 64 shown in FIG. 3.

The control valve 58 is preferably an electrically operated valve having open and closed positions and connected in a control circuit (not shown) which opens the valve to emit a fine water spray through the nozzle 56 in response to operation of the blower 39. The control circuit preferably also includes an independently operable manual switch (not shown) for maintaining the valve 58 in closed condition to disable the humidifier independently of operation of the blower 39 so that the heating system may be operated independently of the humidifying system.

The humidifier 14 may be installed in an existing home heating installation such as generally aforedescribed. After disconnecting the stack 23 from the furnace 12 the furnace housing and the associated structure contained is separated from the base pan 40 and elevated to a position above and in vertically spaced relation relative to the floor 20. While the furnace 12 is maintained in elevated position the base pan 40 is separated from the feeder duct 17.

The feeder duct which rests on the floor is usually connected to the base pan by passing the feeder duct upwardly through the opening 42, cutting the corners of the feeder duct at its upper end and bending the upper marginal portions of the feeder duct outwardly to form a flange around the duct which flange rests on the upper surface of the base pan after assembly. This flange may be sealed to the base pan with duct tape. Where this assembly technique has been used to assembly the feeder duct to the base pan the base pan is separated from the duct 17 by first removing the duct tape and thereafter bending each outwardly flanged marginal portion of the feeder duct upwardly to a position substantially within the plane of an associated wall of the feeder duct. The base pan 40 may then be lifted free of the feeder duct leaving the upwardly directed flanges on the duct extending upwardly above the floor surface.

The air conditioner or humidifier unit 14 is next positioned on the floor in registry with the feeder duct 17 and with the upwardly extending flanges on the duct projecting into the passageway 50. The connection between the humidifier unit 14 and the feeder duct 17 may be sealed with duct tape or other suitable sealing material as desired.

The base pan 40 is next positioned on the upper surface of the humidifier unit 14 with the air outlet 28 in registry with the passageway 50. If tabs are formed on the base pan which extend into the opening 42, such as the tabs 66,66 as shown in FIG. 1, these tabs may be bent downwardly into the passageway 50 to aid in maintaining registration between the air outlet 28 and the passageway 50. The connection between the humidifier and the base pan 42 may be further sealed in the region of the passageway 50 using duct tape or other suitable sealing material as desired. The combustion duct 44, which depends from the base pan is inserted downwardly through the compartment 54 defined by the body of the humidifier unit 14.

Figure 3:
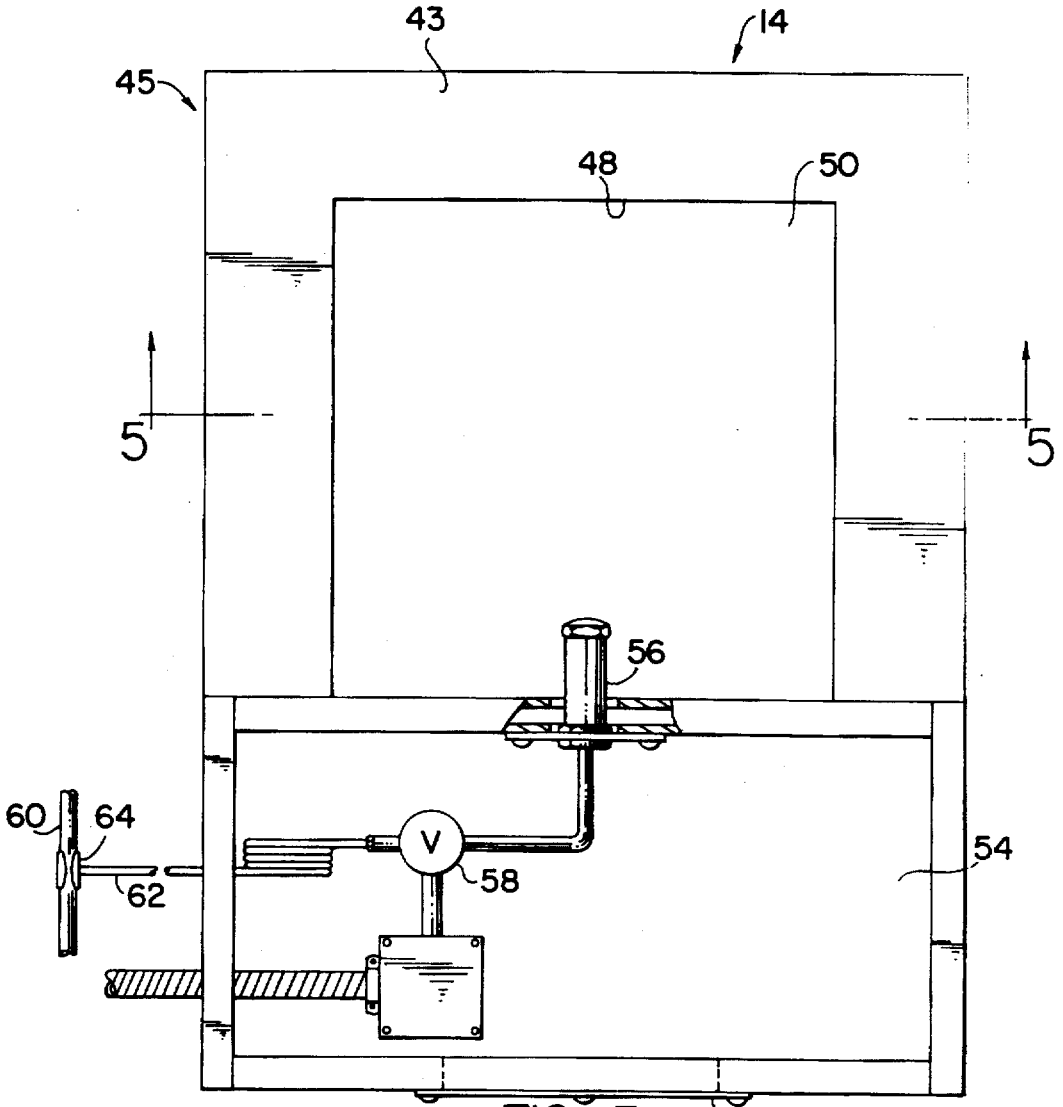
FIG. 3 is a plan view of the humidifier unit.
Figure 4:
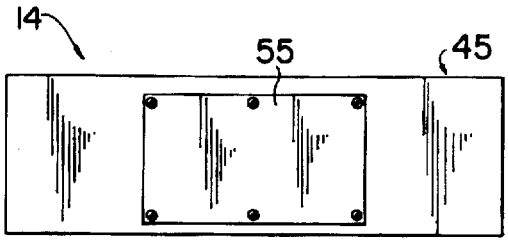
FIG. 4 is a front end elevational view of the humidifier unit.
Figure 5:
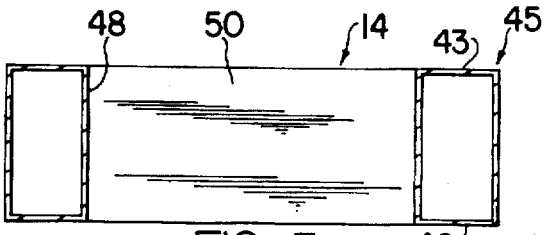
FIG. 5 is a sectional view taken along the line 5—5 of FIG. 3.

The installation is completed by lowering the furnace and engaging the furnace housing 24 with the base pan 40 in the usual manner, reconnecting the stack 23 of the roof jack 13 to the furnace 12, as necessary, connecting the flexible supply line 62 to an appropriate water supply source such as the supply tube 60 using a threaded saddle valve, such as the saddle valve indicated at 64 in FIG. 3, and connecting the control valve 58 to its associated control circuit.

I claim:

1. In a heating and air conditioning system for a building having a floor and a heat distribution duct disposed below the floor, a feeder duct communicating with the heat distribution duct and extending upwardly through the floor, a counter-flow heating appliance disposed above the floor and including a housing having an air inlet in the upper portion thereof and base means defining an air outlet therethrough communicating with the interior of the housing and the feeder duct, a heat source contained within the housing, and means for directing air along a flow path from the air inlet downwardly past the heat source into and through the air outlet and the feeder duct and into the heat distribution duct, and air conditioning means for generally controlling the quantity of moisture in a portion of the flow path, the improvement wherein said air conditioning means comprises an air conditioning unit disposed below said heating appliance and externally of said housing between said housing and said floor and having a body defining a passageway therethrough communicating with said air outlet and said feeder duct, said passageway defining a portion of said air flow path between said air outlet and said feeder duct.

2. In a heating and air conditioning system as set forth in claim 1 the further improvement wherein said air conditioning unit rests on and is supported by said floor and said counter-flow heating appliance rests on and is structurally supported above said floor by said air conditioning unit.

3. In a heating and air conditioning system as set forth in claim 1 the further improvement wherein said air conditioning means comprises a humidifier for discharging moisture into said passageway and including a spray nozzle and means for connecting said spray nozzle in communication with a water supply source.

4. In a heating and air conditioning system as set forth in claim 3 wherein said means for directing air comprises a blower the further improvement wherein said air conditioning means is further characterized as a humidifier for introducing moisture into said passageway in response to operation of said blower.

5. In a heating and air conditioning system as set forth in claim 1 wherein said base means is disposed at the lower end of said housing, the further improvement wherein said passageway is characterized as a vertically disposed passageway.

6. In a home heating and humidifying installation wherein the home has a floor defining a floor surface and the heating installation includes a base pan supported on the floor surface, a feeder duct extending upwardly through the floor and terminating at a air outlet opening through said base pan, and a counter flow air furnace received in and supported by the base pan and having a housing disposed in engagement with the base pan, said air outlet communicating with the interior of said housing, a heat exchanger contained within said housing, and a blower disposed within said housing above said heat exchanger for moving air downwardly past said heat exchanger and outwardly through said air outlet, the improvement comprising a humidifier unit disposed between said base pan and said floor surface and resting on said floor surface, said humidifier unit having spaced apart inner and outer walls and structurally supporting said base pan and said furnace on said floor, said humidifier unit defining a passageway communicating with the interior of said housing and said air outlet, said humidifier unit having a spray nozzle including an outlet end disposed within said passageway, means for connecting said nozzle to a source of water under pressure, and means for releasing a water spray from said nozzle in response to the operation of said blower.

7. In a home heating and humidifying installation as set forth in claim 6 wherein the installation includes a combustion duct extending upwardly through the floor and terminating at a combustion outlet opening through the base pan, the improvement wherein said humidifier has a compartment separated from said passageway and said combustion duct extends through said compartment.

8. A method for installing an air conditioning unit in a heating system having a below-the-floor heat distribution duct, a feeder duct communicating with the heat distribution duct and extending upwardly through the floor, a counter-flow heating appliance supported on the floor and including a housing having an air inlet in the upper portion thereof, and means defining an air outlet communicating with the interior of the housing and the feeder duct, a heat source contained within the housing, and means for directing air along a flow path from the air inlet downwardly past and in heat exchanging relation relative to the heat source and into and through the air outlet and the feed duct to the heat distribution duct, said method comprising the steps of providing a an air conditioning unit having a body defining a passageway therethrough, elevating the heating appliance to a position wherein it is disposed in vertically spaced relation to the upper surface of the floor, positioning the air conditioning unit on the floor between the upper surface of the floor and the bottom wall of the furnace with the passageway in communication with the feeder duct, and lowering the heating appliance onto the air conditioning unit after positioning the air conditioning unit.

9. A method for installing an air conditioning unit in a heating system as set forth in claim 8 wherein the heating appliance includes a base pan having an opening therethrough in complementary registration with the air outlet and the feeder duct is connected to the base pan, the additional steps of separating the base pan from the feeder duct before positioning the air conditioning unit, and positioning the base pan on the air conditioning unit with the opening in generally complementary registration with the upper end of the passageway, and the step of lowering the heating appliance is further characterized as lowering the heating appliance onto the base pan.

10. A method for installing an air conditioning unit in a heating system as set forth in claim 9 wherein the feeder duct is connected to the base pan by laterally outwardly bent flanges on the upper end of said feeder duct which flanges rest on the upper surface of the base pan and wherein the step of separating the base pan is further characterized as bending the flanges on the feeder duct upwardly and lifting the base pan relative to the feeder duct and the step of positioning the air conditioning unit is further characterized as positioning the air conditioning unit on the floor with the passageway in registration and communication with the feeder duct and the flanges on the feeder duct extending into the passageway.

11. A method for installing an air conditioning unit in a heating system as set forth in claim 9 wherein the air conditioning unit has a compartment therein spaced from the passageway and the base pan has a combustion duct depending therefrom and the step of positioning the base pan is further characterized as extending the combustion duct downwardly through the compartment.

12. In a heating and air conditioning system for a building having a floor and a heat distribution duct disposed below the floor, a feeder duct communicating with the heat distribution duct and extending upwardly through the floor, a counter-flow heating appliance disposed above the floor and including a housing having an air inlet in the upper portion thereof and a base pan having an opening therethrough defining an air outlet therethrough communicating with the interior of the housing and the feeder duct, a heat source contained within the housing, and means for directing air along a flow path from the air inlet downwardly past the heat source into and through the air outlet and the feeder duct and into the heat distribution duct, and air conditioning means for generally controlling the quantity of moisture in a portion of the flow path, the improvement wherein said air conditioning means comprises an air conditioning unit disposed below said heating appliance and externally of said housing between said housing and said floor and resting on and supported by said floor, said air conditioning unit having a body defining a passageway therethrough communicating with said air outlet and said feeder duct, said passageway defining a portion of said air flow path between said air outlet and said feeder duct, said base pan being supported on said air conditioning unit, said housing being supported on said base pan with said air outlet in registry with said passageway, whereby said counter-flow heating appliance rests on and is structurally supported above said floor by said air conditioning unit.

13. In a heating and air conditioning system as set forth in claim 12 wherein said base pan has a combustion duct depending therefrom which communicates with the interior of the heating appliance and extends downwardly through the floor the further improvement wherein said air conditioner defines a compartment separated from said passageway and said combustion duct extends through said compartment.

14. In a heating and air conditioning system as set forth in claim 12 wherein said body partially defines a chamber separated from said passageway by a wall of said body and said air conditioning means includes a nozzle assembly extending from said chamber into said passageway.

15. In a heating and air conditioning system for a building having a floor and a heat distribution duct disposed below the floor, a feeder duct communicating with the heat distribution duct and extending upwardly through the floor, a counter-flow heating appliance disposed above the floor and including a housing having an air inlet in the upper portion thereof and base means defining an air outlet therethrough communicating with the interior of the housing and the feeder duct, a heat source contained within the housing, and means for directing air along a flow path from the air inlet downwardly past the heat source into and through the air outlet and the feeder duct and into the heat distribution duct, and air conditioning means for generally controlling the quantity of moisture in a portion of the flow path, the improvement wherein said air conditioning means comprises an air conditioning unit disposed below said heating appliance and externally of said housing between said housing and said floor and having a body including an inner wall defining a passageway therethrough communicating with said air outlet and said feeder duct and outer walls spaced laterally outwardly from said inner wall and comprising means for insulating said passageway, said passageway defining a portion of said air flow path between said air outlet and said feeder duct.

16. In a heating and air conditioning system as set forth in claim 15 the further improvement wherein said air conditioning means comprises a humidifier for discharging moisture into said passageway and including a spray nozzle and means for connecting said spray nozzle in communication with a water supply source.

17. In a heating and air conditioning system as set forth in claim 16 wherein said means for directing air comprises a blower the further improvement wherein said air conditioning means is further characterized as a humidifier for introducing moisture into said passageway in response to operation of said blower.

18. In a heating and air conditioning system for a building having a floor and a heat distribution duct disposed below the floor, a feeder duct communicating with the heat distribution duct and extending upwardly through the floor, a counter-flow heating appliance disposed above the floor and including a housing having an air inlet in the upper portion thereof and base means defining an air outlet therethrough communicating with the interior of the housing and the feeder duct, a heat source contained within the housing, and means for directing air along a flow path from the air inlet downwardly past the heat source into and through the air outlet and the feeder duct and into the heat distribution duct, and air conditioning means for generally controlling the quantity of moisture in a portion of the flow path, the improvement wherein said air conditioning means comprises an air conditioning unit disposed below said heating appliance and externally of said housing between said housing and said floor and having a body defining a passageway therethrough communicating with said air outlet and said feeder duct, said body partially defining a chamber separated from said passageway by a wall of said body said passageway defining a portion of said air flow path between said air outlet and said feeder duct said conditioning means including a nozzle assembly extending from said chamber into said passageway.

19. In a heating and air conditioning system as set forth in claim 18 at the further improvement wherein said heating appliance includes a combustion duct communicating with the interior of said housing and said combustion duct extends through said chamber and downwardly through the floor.

* * * * *

UNITED STATES PATENT AND TRADEMARK OFFICE

CERTIFICATE OF CORRECTION

PATENT NO. : 5,740,790

DATED : April 21, 1998

INVENTOR(S) : Steve S. Lipsky, Jr.

It is certified that error appears in the above-indentified patent and that said Letters Patent is hereby corrected as shown below:

On the title page, item [54] and column 1, line 2, after "CONDITIONING" insert --SYSTEM AND--.

Signed and Sealed this

Seventh Day of July, 1998

Bruce Lehman

*Attest:*

BRUCE LEHMAN

*Attesting Officer*

*Commissioner of Patents and Trademarks*